United States Patent [19]

Kiefer

[11] 4,331,203

[45] May 25, 1982

[54] METHOD AND APPARATUS FOR THE INSTALLATION AND WITHDRAWAL OF PUMPING EQUIPMENT IN AN UNDERWATER WELL

[75] Inventor: Karl Kiefer, Bartlesville, Okla.

[73] Assignee: TRW Inc., Cleveland, Ohio

[21] Appl. No.: 190,751

[22] Filed: Sep. 25, 1980

[51] Int. Cl.[3] ..... E21B 23/00; E21B 33/064; E21B 33/068

[52] U.S. Cl. ..... 166/339; 166/360; 166/362; 166/68

[58] Field of Search ..... 166/338, 339, 340, 341, 166/344, 351, 360, 362, 363, 68, 82

[56] References Cited

U.S. PATENT DOCUMENTS

| | | | |
|---|---|---|---|
| 3,090,437 | 5/1963 | Geer | 166/341 |
| 3,142,337 | 7/1964 | Poorman, Jr. et al. | 166/66.5 |
| 3,163,223 | 12/1964 | Bauer et al. | 166/66.5 |
| 3,233,666 | 2/1966 | Geer et al. | 166/0.5 |
| 3,280,908 | 10/1966 | Todd | 166/340 |
| 3,339,632 | 9/1967 | Lewis | 166/0.6 |
| 3,412,789 | 11/1968 | Ralph et al. | 166/0.6 |
| 3,513,911 | 5/1970 | Petersen | 166/0.6 |
| 3,517,736 | 6/1970 | Waldron | 166/0.5 |
| 3,602,303 | 8/1971 | Blenkarn et al. | 166/0.5 |
| 3,637,009 | 1/1972 | James | 166/0.5 |
| 3,638,722 | 2/1972 | Talley, Jr. | 166/0.5 |
| 3,653,435 | 4/1972 | Reistle et al. | 166/344 X |
| 3,662,822 | 5/1972 | Wakefield, Jr. | 166/0.5 |
| 4,278,362 | 7/1981 | Scherrer | 166/339 X |

*Primary Examiner*—Stephen J. Novosad

*Attorney, Agent, or Firm*—Shapiro and Shapiro

[57] ABSTRACT

Methods and apparatus are disclosed for transporting submergible pumping equipment between an underwater well and the water surface and for installing the equipment in and withdrawing the equipment from the well. The apparatus includes a container in the form of an elongate casing in which the equipment is suspended and which is raised and lowered between the wellhead and the surface to transport the equipment therebetween, the casing being connected to wellhead apparatus for installation and withdrawal of the equipment in the well. The casing is divided by a series of blowout preventers into an upper and a lower chamber. In use, the equipment is transported in the lower chamber and a diffractant solution is circulated through the lower chamber while the upper chamber is maintained at a high liquid pressure to provide a barrier inhibiting leakage of contaminants from within the lower chamber to the outer environment.

15 Claims, 5 Drawing Figures

METHOD AND APPARATUS FOR THE INSTALLATION AND WITHDRAWAL OF PUMPING EQUIPMENT IN AN UNDERWATER WELL

BACKGROUND OF THE INVENTION

The invention relates to methods and apparatus for the installation and withdrawal of submergible pumping equipment in underwater wells.

Increasing demand and price of petroleum products have greatly stimulated the sub-sea exploration for and production of oil and gas. Until recently, such activities have centered around off-shore platforms, but with the need for operating at greater depth and with greater flexibility, sub-sea wells remote from or even independent of off-shore platforms have become more attractive. Such sub-sea wells may have production trees that are remotely or automatically controlled, with production tubing extending along the ocean floor to a remote depot.

Installing and energizing submergible pumps in such sub-sea wells involve difficult problems. Running and pulling operations are expensive and should be minimized and simplified to the extent possible. The avoidance of oil spills during the running and pulling operations as well as during production pumping is a further priority. Thus, the running and pulling apparatus and also the permanent wellhead and sub-sea equipment must provide integrity against oil leakage.

Another problem area is the provision of suitable electrical energization to the motor associated with the downwell pump. Particular attention must be directed to the form of electrical connections used at the wellhead between the electrical supply cable and the suspended motor to provide adequate sealing of the components and security against oil leakage. My copending U.S. patent application Ser. No. 078,907, filed Sept. 25, 1979, now U.S. Pat. No. 4,304,452, is directed particularly towards this electrical connector aspect of sub-sea well pump and motor installations. The present invention, by contrast, is more particularly concerned with aspects concerning the running and pulling sequences for installing the pumping equipment in and withdrawing the pumping equipment from a sub-sea well, and with apparatus used for this purpose.

SUMMARY OF THE INVENTION

A general object of the invention is to provide methods and apparatus for installing and withdrawing pumping equipment in sub-sea wells, which operate efficiently and minimize the danger of oil spills.

More specifically, it is an object of the invention to provide a novel apparatus in the form of a container (e.g., a lubricator or riser) which may be used to transport submergible pumping equipment between an underwater well and the surface and which may be used in performing the actual installation and withdrawal operations of the equipment in the well.

Another object of the invention is to provide apparatus as referred to in the preceding paragraph which is adapted to minimize the possibility of oil leakage therefrom.

Another object of the invention is to provide novel methods and apparatus for installing and withdrawing pumping equipment in an underwater well which minimize the possibility of oil spills during transportation of the apparatus between the wellhead and the water surface and during actual installation and withdrawal of the equipment at the wellhead.

Pursuant to the above objects, the invention provides, in one of its broader aspects, container apparatus in the form of an elongate casing in which suspended well pumping equipment may be transported between the water surface and an underwater wellhead. This apparatus may in accordance with further features of the invention be connected to the wellhead apparatus during the actual installation and withdrawal sequences of the pumping equipment into and from the well.

The container apparatus, in a preferred form of the invention, is divided longitudinally by a series of annular blowout preventers into upper and lower chambers. In use, the suspended pumping equipment may be transported between the wellhead and the surface in the lower chamber with a suspension cable or the like for the equipment extending upwardly out of the apparatus through the upper chamber and with the relevant blowout preventers closed around the cable. During raising or lowering of the apparatus between the wellhead and the water surface, diffractant liquid is preferably circulated through the lower chamber to cleanse the equipment contained therein, while the upper chamber is pressurized with high-pressure liquid. The upper chamber thereby forms a high-pressure barrier between the equipment-containing lower chamber and the outer environment which inhibits escape of any contaminants along the cable from within the lower chamber to the outer environment.

When the container apparatus is connected to the wellhead apparatus for performing the actual installation or withdrawal sequences, the above-referred to circulation of liquid through the lower chamber of the apparatus and pressurization of the upper chamber may be continued during lowering or raising of the pumping equipment through the apparatus. The blowout preventers are opened and closed selectively for passage of the pumping equipment through the apparatus. Circulation of liquid through the lower chamber of the apparatus and pressurization of the upper chamber may be effected by flush lines which lead into the respective chambers from the water surface.

The inventive apparatus and methods of pump installation and withdrawal provide protection against leakage during the transportation of the equipment between the wellhead and the water surface, and also provide multilevel protection against blowout of the well during the actual installation and withdrawal sequences.

The invention will now be described by way of example with reference to the accompanying drawings.

DESCRIPTION OF THE PREFERRED EMBODIMENT

Figure 1:
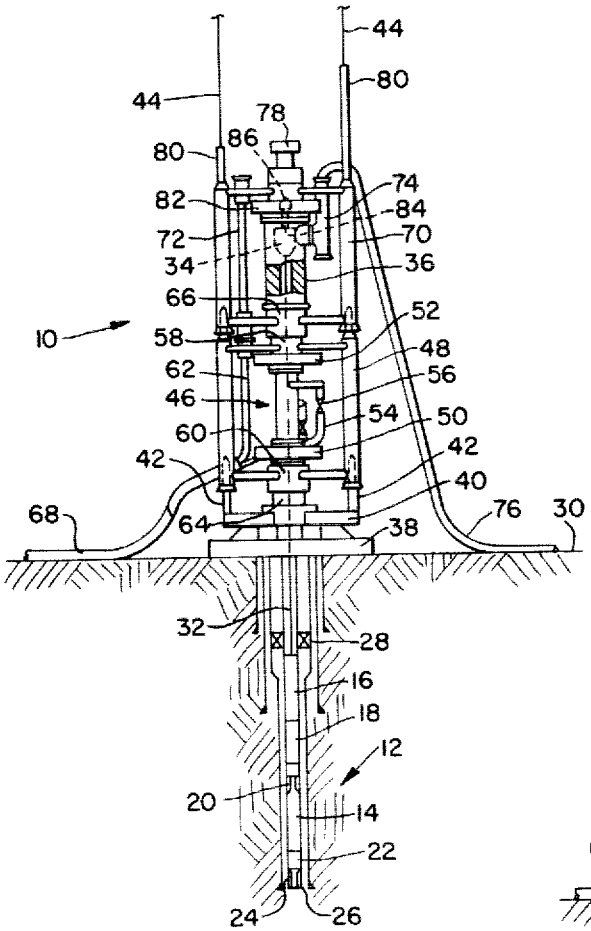
FIG. 1 is a semi-diagrammatic elevational view of a sub-sea well and wellhead apparatus, the figure showing submergible pumping equipment installed in pumping position in the well.

By way of introduction, FIG. 1 shows a typical subsea oil well and associated wellhead apparatus with the pumping equipment already installed in pumping position in the well. The wellhead apparatus is generally indicated by reference 10 and the well itself by reference 12. Well 12 may be conventional and include the usual casing and pipe strings. Suspended in the well is a submergible pump assembly, which may include a conventional submergible pump 14, an electric motor 16 for driving the pump, a protector 18, a packoff and lock 20 isolating the inlet side of the pump from the discharge side, a hydraulic safety valve 22 and a valve actuator 24 for a mechnical isolation valve 26 at the bottom of an inner pipe string of the well. A vented annulus packer 28 may be employed between coaxial pipe strings of the well as shown. The well casing and pipe strings are shown diagrammatically and may be extended to the desired depth below the mudline or floor 30 of the body of water above the well. The pump and associated components may be suspended by a cable 32 (or alternatively by a pipe string) attached at its upper end to a suspension head 34 seated in an adapter spool 36 of the wellhead apparatus.

The wellhead apparatus may also include a temporary guide base 38, a guide base 40 with guide posts 42, guide cables 44 leading from the guide posts to buoys or a platform, and a production tree 46 including a guide frame 48, a master valve 50, a full-opening valve 52, flow lines 54, a wing valve 56, hydraulic connectors 58 and 60 and a hydraulic interconnect 62. Hydraulic connector 60 mates with a hydraulic connector 64 on the guide base 38 while hydraulic connector 58 mates with a hydraulic connector 66 at the bottom of spool 36. Elements of guide frame 48 mate with corresponding guide posts 42. Production tubing 68 leads from the production tree 46 to a remote platform or depot, for example.

Adapter spool 36 is mounted on a guide frame 70, elements of which mate with elements of guide frame 48. A hydraulic interconnect 72 mates with the corresponding hydraulic interconnect 62 of the production tree. The spool has an associated electrical power interconnect 74 which receives a power cable 76 leading from an electrical power source. A removable corrosion cap 78 is provided at the top of spool 36. Reentry guide posts 80 extend upwardly from frame 70 and guide cables 44 pass through the guide frames and guide posts in sequence. A full-opening valve 82 may be provided at the top of spool 36 below corrosion cap 78.

Suspension head 34 has an extension 84 and knob 86 by which the suspension head may be attached to a running tool (to be described) for installing the pump assembly into and withdrawing it from the well. Further, head 34 seats in an electrical contact region of spool 36 in a manner whereby electric current can pass from interconnect 74, through spool 36, head 34 and elements of cable 32 to motor 16. The design of spool 36 and head 34 to provide the required electrical connections does not form part of the present invention, but one preferred design of these components is, for example, described in detail in the above-noted copending patent application, the disclosure of which is incorporated herein by reference.

To install and withdraw the pumping equipment (comprising suspension head 34 and the suspended pump assembly) in and from the well, use is made of a container apparatus 90 shown in FIGS. 2–5, which may be lowered and raised between the water surface and the wellhead as will be described. The installation and withdrawal sequences of the present invention, using container apparatus 90, are performed with the wellhead apparatus already assembled in the condition shown in FIG. 1 (except that in the case of the installation sequence, the pumping equipment will not be in the well). Thus, the manner in which the temporary guide base 38, guide base 40, guide frame 48, guide frame 70 and the remainder of the apparatus shown in FIG. 1 are assembled, prior to installation of the pumping equipment, does not form part of the present invention and such assembly may be performed in known manner under diver control or by diverless techniques.

Referring now particularly to FIGS. 2–5, container apparatus 90 is in the form of an elongated generally cylindrical casing which, as will be described, provides protection against leakage of contaminants from within the casing during transport of the pumping equipment between the water surface and the wellhead and during the actual installation and withdrawal sequences. Container apparatus 90 is preferably a form of "lubricator" incorporating a novel arrangement of blowout preventers and hydraulics. At its upper end, the container apparatus carries a guide frame 92 providing a fastening for tensioning cables 94 which partially relieve tension on cable 32 and which stabilize the container apparatus as it is raised and lowered between the surface and the wellhead apparatus. Frame 92 further may be provided with a TV monitor 96 and a leakage detector 98. Below frame 92 the main cylindrical casing of container apparatus 90 includes four axially spaced hydraulically operatd annular blowout preventers (BOPs) 100–106, which may each be a conventional form of bag or iris-type preventer, and which in use, provide annular closure and sealing of the apparatus under direct hydraulic control from the surface. The BOPs also divide the casing of container apparatus 90 into an upper pressure chamber 108 and a lower isolation chamber 110 which, as will be described, is used to house the pumping equipment during transportation between the water surface and the wellhead. Chambers 108 and 110 also provide environmental protection by inhibiting leakage of contaminants from within the casing during passage of cable 32 and generally during the installation and withdrawal of the pumping equipment. Chamber 108 communicates with a flush line 112 through which the chamber can be pressurized from the surface with liquid such as sea water or a diffractant solution, and chamber 110 communicates with a pair of longitudinally spaced flush lines 114, 116 by which a diffractant liquid can be circulated through this chamber from the surface. Liquid may be supplied to the respective flush lines by suitable surface-mounted pumping means. When closed, BOPs 100 and 102 isolate chamber 108 and BOPs 102 and 104 isolate chamber 110. Preventer 106 may be used as a backup to preventer 104 when tight stripping operations are required.

A hydraulically operated shear ram 118 of conventional type is located below BOP 106 to provide the capability of severing any equipment passing through the container apparatus in the event of emergency. Below the shear ram is a flex-joint 120 and a hydraulic connector 122 which attaches to the upper end of adapter spool 36 upon removal of corrosion cap 78. The lower end of container apparatus 90 may also, as shown, carry a guide frame 124 with entry guides 126 adapted to register with guide posts 80 of frame 70. Guide frame 124 may also be provided with a TV monitor 130 for monitoring, inter alia, proper registration of the container apparatus with the wellhead apparatus. A hydraulic control line bundle 132 leading from the surface comprises individual hydraulic lines for the various BOPs, the shear ram and the hydraulic connector, for selective remote actuation of these components. Internally, container apparatus 90 may be provided with a series of sensor devices (not shown) for detecting the position of pumping equipment as it is moved through the apparatus, to provide information relevant for timing the opening and closing of the various BOPs. Such sensor devices may be of conventional form, for example, magnetic or capacitive proximity devices. Alternatively, changes in the position of the equipment relative to the BOPs, as the equipment is moved through the container apparatus, may be sensed by fluctuations in the tension or weight on the cable from which the equipment is suspended.

Figure 2:
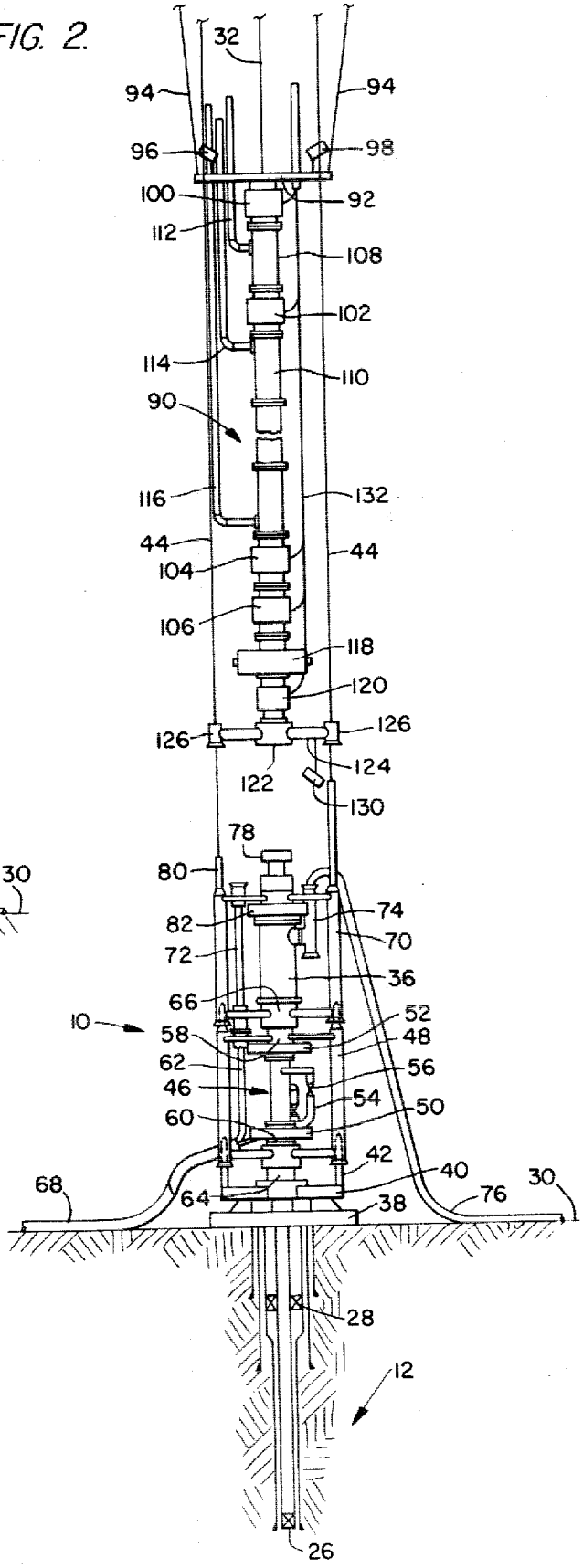
FIG. 2 is a view similar to FIG. 1 showing a container apparatus in accordance with one aspect of the invention being lowered toward the wellhead apparatus preparatory to the installation of the pumping equipment in the well.

A sequence in accordance with the invention for installing the pumping equipment within the well will now be described with reference to FIGS. 2–5. This sequence may be initiated when artificial lift is required from well 12, with the wellhead apparatus as shown in FIG. 1 already having been assembled and with the corrosion cap 78 in place. Initially, the corrosion cap may be removed by any conventional cap removal means and then container apparatus 90 may be lowered from the surface by cables 94 and with entry guides 126 running on guide cables 44 as shown in FIG. 2. During downward travel of the container apparatus, the pump assembly (pump 14, protector 18 and motor 16) suspended on cable 32, is located within isolation chamber 110 and all of the BOPs 100–106 are closed (BOPs 100 and 102 being closed on cable 32 between the pump assembly and the suspension head). Further, during this phase of the sequence, a diffractant liquid such as detergent-containing sea water may be circulated from the surface through isolation chamber 110 via flush lines 114, 116 to cleanse the pump assembly, if required, and chamber 108 may be pressurized with liquid such as sea water or a diffractant solution via flush line 112. In this connection it is noted that the pressure in chamber 108 should be maintained above that in chamber 110 and above the ambient hydrostatic head. This provides a high-pressure barrier between chamber 110 and the outer environment, to prevent any contaminants which may be present in chamber 110 from leaking past cable 32, into the sea, any leakage which may occur across BOP 102 taking place from the "clean" chamber 108 into chamber 110. Pressurization of chambers 108 and 110 may be varied automatically or manually to account for ambient pressure variation.

Figure 3:
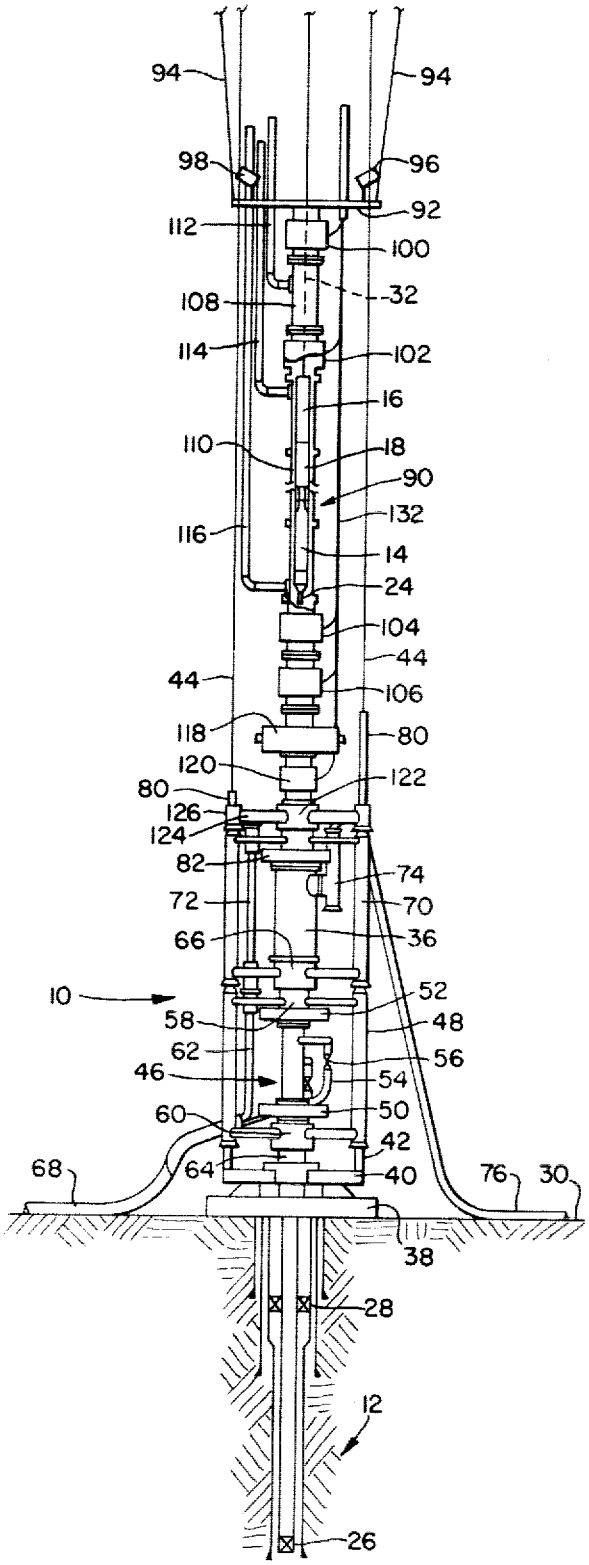
FIGS. 3–5 are views similar to FIG. 2 showing progressive stages in the installation of the pumping equipment in the well.
Figure 4:
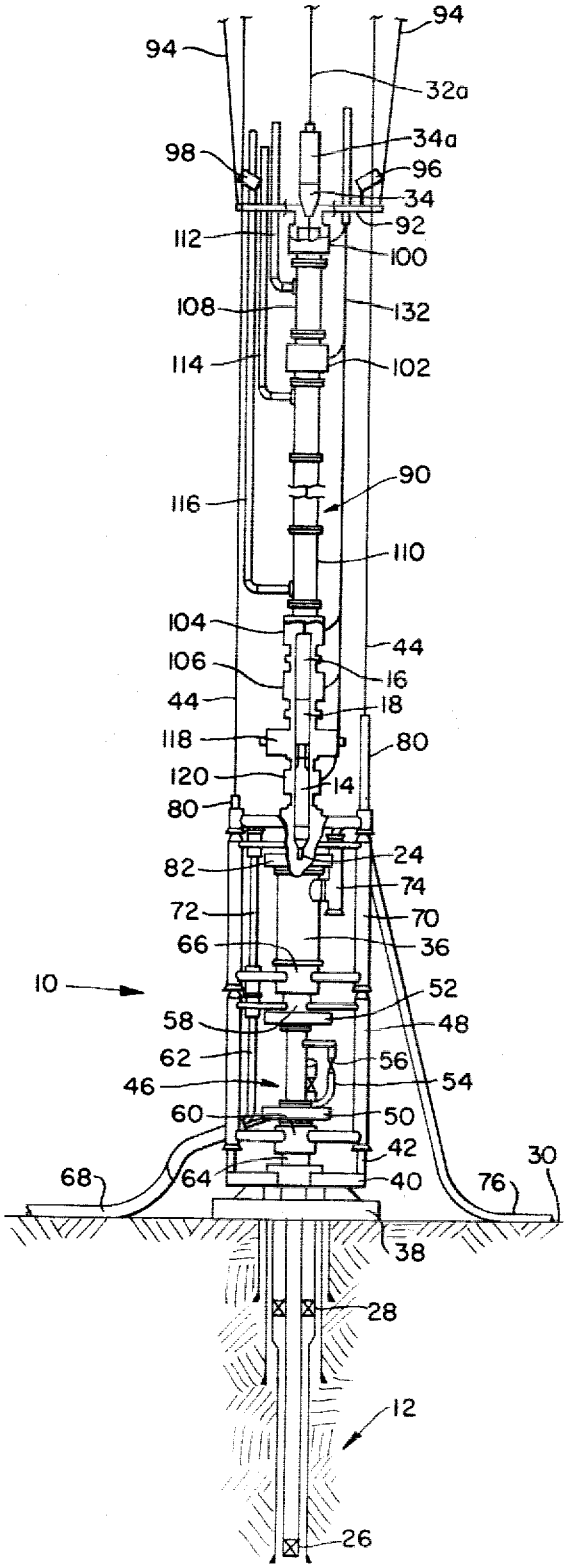
Figure 5:
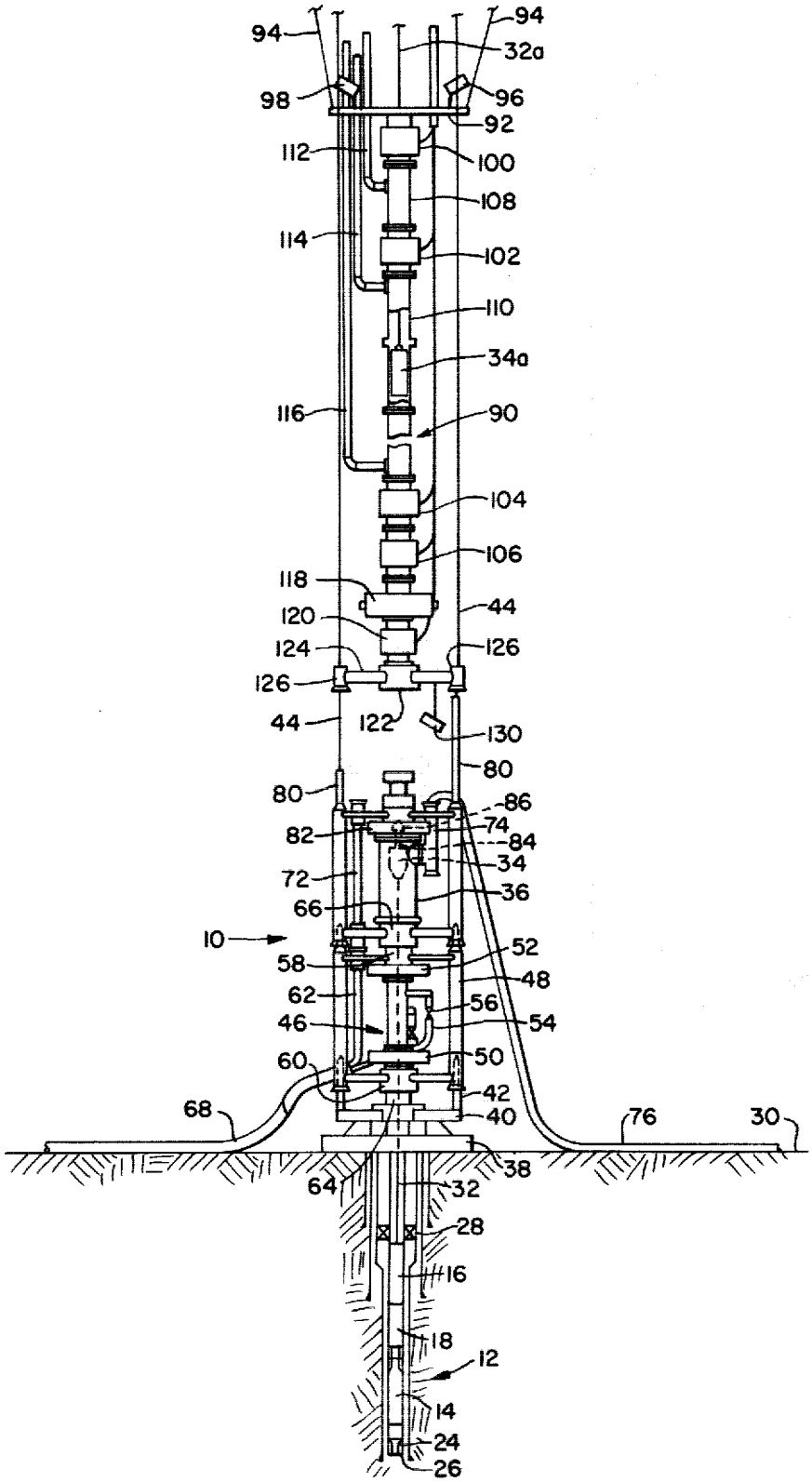

Container apparatus 90 is lowered, as described above, to a position in which hydraulic connector 122 registers with the head of adapter spool head 36 and the connector is then locked to the adapter spool head (see FIG. 3). The integrity of the well is maintained during this phase of the sequence by the previously referred to valves in the well and the wellhead apparatus.

After mating of hydraulic connector 122 with adapter spool 36, the wellhead valves may be opened for pressure checking of the apparatus, the well integrity being maintained, inter alia, by the BOPs in container apparatus 90. The pumping assembly may then be run into the well. To this end, BOPs 104 and 106 are opened and the pump assembly is lowered through the container apparatus. When the pump assembly has passed BOPs 104 and 106, these BOPs are closed into a stripping mode on cable 32, and running of the pump assembly is continued until suspension head 34 and a running tool **34*a* to which it is releasably connected reach BOP 100 (see FIG. 4). The construction of suspension head 34 and running tool 34*a*** and the releasable connection therebetween may, for example, be as disclosed in the aforesaid co-pending patent application.

BOP 100 is now opened to allow suspension head 34 and running tool **34*a* to pass through, and this BOP is then closed on suspension cable 32*a*. BOP 102 is then opened and the suspension assembly (head 34 and tool 34*a*) is passed into chamber 110, whereupon BOP 102 is closed. When BOP 102 is opened, pressure equalization between chambers 108 and 110 may be effected by temporarily stopping the pumping means used for supplying liquid to the respective flush lines. The suspension assembly is passed down through chamber 110 and BOPs 104 and 106 are opened. When the assembly has passed BOPs 104 and 106**, these are again closed.

Lowering of cable **32*a* is continued until actuator 24 at the base of the pumping assembly opens valve 26 and packoff and lock 20 are set in the well casing. Suspension head 34 is then lowered into and seated in the adapter spool. BOPs 104 and 106 may be opened so as to flush the electrical connection and packoff areas of the head and spool with the circulating detergent liquid from chamber 110, prior to final seating of the suspension head in the adapter spool. Sufficient slack may be provided in cable 32 to ensure engagement of the actuator 24 with valve 26 prior to seating of suspension head 34** in the adapter spool.

Then, preferably in the manner disclosed in the aforesaid co-pending patent application, electrical connection and packoff are established between head 34 and adapter spool 36, the electrical contact region between the head and spool being cleaned and then flooded with heavy dielectric fluid from running tool **34*a*. Subsequently, the running tool is detached from head 34 and lifted up through BOPs 104 and 106 by cable 32*a* into chamber 110. BOPs 104 and 106 are left open and the container apparatus is pressurized with liquid up to a pressure exceeding the maximum designed wellhead pressure. Valve 82 is closed and the pressure in container apparatus 90 is adjusted, leaving the electrical connection chamber in the adapter head over-pressured. BOPs 106 and 104** are then closed.

The final stages of the running sequence comprise detaching hydraulic connector 122 from the adapter spool, replacing corrosion cap 78 and pulling the container apparatus to the surface. In the latter operation, running tool **34*a* is accommodated in chamber 110 as shown, for example, in FIG. 5. Once again, during this pulling operation, circulation of diffractant solution through chamber 110 via flush lines 114, 116, may be continued, while maintenance of high-pressure liquid in chamber 108 via flush line 112 provides a pressure barrier inhibiting leakage of contaminants from chamber 110** into the sea.

Circulation of diffractant liquid through chamber 110 and pressurization of chamber 108 may take place throughout the entire installation sequence, as described above. Any leakage which may occur through BOPs 100 and 102 will therefore always be of "clean" liquid from within the high-pressure chamber 108.

For withdrawing the pumping equipment from the well in accordance with the invention, utilizing container apparatus 90, a sequence of operations, which is essentially a reverse of the installation sequence, may be followed.

Thus, running tool 34*a* is initially suspended within chamber 110 of the container apparatus and the apparatus is lowered to the wellhead while flushing chamber 110 and pressurizing chamber 108. Corrosion cap 78 may be removed as previously described, with valve 82 closed, and the container apparatus may then be locked to adapter spool 36 by hydraulic connector 122. Valve 82 is opened and running tool 34*a* is lowered through the container apparatus (after opening BOPs 104, 106) and coupled to suspension head 34. While BOPs 104 and 106 are open, the container apparatus may again be pressurized to above the maxmimum designed well pressure. The suspension assembly of running tool 34*a* coupled to suspension head 34, is then lifted into chamber 110 and BOPs 104, 106 are closed. The suspension assembly is flushed with diffractant solution in chamber 110, and then BOP 102 is opened, allowing the suspension assembly to be lifted into chamber 108. Pressure equalization between chambers 108 and 110 when BOP 102 is opened may again be effected as described above. BOP 102 is then closed, the flush lines repressurized, BOP 100 is opened and the suspension assembly lifted out of the container apparatus. BOP 100 is then closed.

Raising of cable 32*a* is continued until the pump assembly reaches BOP 106, whereupon BOPs 104 and 106 are opened and the pump assembly is admitted to chamber 110. BOPs 104 and 106 are then closed. Valve 82 can now be closed and the wellhead capped as previously described. Container apparatus 90 can then be raised to the surface with the pump assembly contained in chamber 110, while this chamber is flushed with diffractant as previously described and chamber 108 is suitably pressurized to inhibit leakage from chamber 110.

It will be appreciated from the foregoing that the invention provides an integrated system for installing and withdrawing well equipment in and from an underwater well, utilizing container apparatus in which the equipment may be situated while being raised or lowered between a water surface and the wellhead and which, due to the creation of a high-pressure barrier at the upper end of the container apparatus, provides a high degree of integrity against leakage of contaminants from within the container both during transport of the equipment to and from the wellhead and while the apparatus is situated at the wellhead.

While only preferred embodiments of the invention have been described herein in detail, the invention is not limited thereby and modifications can be made within the scope of the attached claims. For example, for certain applications container apparatus 90 may be permanently or semi-permanently attached to the wellhead apparatus with the pumping equipment lowered to it from the surface or raised from it to the surface, through a suitable marine riser attached to the upper end of the apparatus. In this arrangement, apart from the steps required for lowering the pumping equipment into the container apparatus and lifting it from the apparatus, which steps will be apparent to those skilled in the art, the above-described installation and withdrawal sequences may still be followed. The apparatus when used in this mode provides an underwater facility for cleansing pumping equipment as it is lowered into or raised from a well, and the high-pressure barrier provided by chamber 108 again inhibits leakage of contaminants from within the apparatus. Further, the BOPs in the apparatus offer multi-level protection against well blowouts.

I claim:

1. Container apparatus for use in the installation and withdrawal of suspended pump equipment with respect to an underwater well, comprising an elongate casing having an upper end and a lower end, a first annular blowout preventer adjacent the upper end of the casing, a second annular blowout preventer adjacent the lower end of the casing, a third annular blowout preventer between said first and second preventers, said first, second and third preventers dividing said casing into upper and lower chambers adapted to communicate via said third preventer, said lower chamber being adapted to accommodate the pumping equipment, means for circulating liquid through the lower chamber, means for supplying liquid under pressure to the upper chamber, means for opening and closing each of said preventers selectively and means for connecting the lower end of the casing to underwater wellhead apparatus.

2. Apparatus as defined in claim 1, wherein said circulating means includes a pair of flush lines communicating with said lower chamber at longitudinally spaced locations.

3. Apparatus as defined in claim 1, wherein said supplying means includes a flush line communicating with said upper chamber.

4. Apparatus as defined in claim 1 including a frame at the upper end of said casing for connecting the casing to suspension cables and the like.

5. Apparatus as defined in claim 1 including a fourth annular blowout preventer between said second preventer and the lower end of said casing.

6. Apparatus as defined in claim 1 including a flex-joint between said second preventer and the lower end of said casing.

7. A method of installing or removing submergible well equipment in or from an underwater well, comprising providing a container apparatus in the form of an elongate casing having upper and lower chambers separated by an annular blowout preventer and further annular blowout preventers at the upper end of said upper chamber and at the lower end of said lower chamber, respectively, suspending the equipment in said lower chamber with suspension means for the equipment passing through said upper chamber, closing said annular preventers and transporting said container apparatus underwater to or from said well with the equipment suspended therein while circulating cleansing liquid through said lower chamber and pressurizing said upper chamber with liquid to a pressure exceeding the pressure of liquid in said lower chamber to provide a barrier inhibiting escape of liquid from said lower chamber through said upper chamber.

8. A method as defined in claim 7 for installing said equipment in the well, wherein said equipment includes a submergible pump assembly suspended in said lower chamber from a suspension assembly externally of said container apparatus and wherein said method includes the steps of lowering said container apparatus under water to the well with said pump assembly suspended in said lower chamber while circulating said cleansing liquid through said lower chamber and pressurizing said upper chamber, connecting the lower end of said container apparatus to wellhead apparatus of the well, opening valve means associated with said wellhead apparatus, to provide passage therethrough for said pump assembly, lowering said pump assembly through said container apparatus and through said wellhead apparatus into pumping position in the well, lowering said suspension assembly through said container apparatus into seating engagement in said wellhead apparatus, and selectively opening and closing said blowout preventers in timed relation to the lowering of said assemblies to provide passage for said assemblies through said container apparatus.

9. A method as defined in claim 8 including the step of flushing a portion of said wellhead apparatus on which said suspension assembly seats with the liquid circulating through said lower chamber after the pump assembly has been lowered into the well and prior to final seating of said suspension assembly, by opening said blowout preventer at the lower end of said container apparatus.

10. A method as defined in claim 8, wherein said suspension assembly comprises a suspended running tool and a detachable suspension head connected to said pump assembly by suspension means, said method including the further steps of detaching said running tool from said suspension head after the suspension assembly is seated in said wellhead apparatus, raising said suspension head into said lower chamber of the container apparatus, said raising of said suspension head being accompanied by selective opening and closing of said blowout preventer at the lower end of said chamber, closing off the wellhead apparatus above said suspension head, disconnecting said container apparatus from said wellhead apparatus and raising said container apparatus from the well with said running tool suspended in said lower chamber while continuing to circulate said liquid through said lower chamber and pressurize said upper chamber.

11. A method as defined in claim 7 for removing said equipment from the well, wherein said equipment includes a submergible pump assembly suspended from a suspension head in wellhead apparatus associated with the well, wherein said method includes the steps of lowering the container apparatus under water with a pulling tool suspended in said lower chamber, while circulating said liquid through said lower chamber and pressurizing said upper chamber, connecting a lower end of said container apparatus to said wellhead apparatus, providing communication between the lower end of said container apparatus and a section of the wellhead apparatus in which the suspension head is seated, opening said blowout preventer at the lower end of said lower chamber, lowering the pulling tool through said lower chamber and into the wellhead apparatus, connecting said pulling tool to said suspension head to form a suspension assembly for the pump assembly, raising the suspension assembly into the lower chamber of said container apparatus, closing the blowout preventer at the lower end of said lower chamber, flushing said suspension assembly in said lower chamber with said circulating liquid, opening said blowout preventer separating said chambers, raising said suspension assembly into said upper chamber, closing said blowout preventer separating said chambers, opening said blowout preventer at the upper end of said upper chamber, raising said suspension assembly out of said container apparatus, closing said blowout preventer at the upper end of said upper chamber, opening said blowout preventer at the lower end of said lower chamber, raising said pump assembly into said lower chamber, closing said blowout preventer at the lower end of said lower chamber, closing off the upper end of said wellhead apparatus, disconnecting said container apparatus from said wellhead apparatus and raising said container apparatus through the water with said pump assembly suspended in said lower chamber while continuing to circulate said liquid through said lower chamber and pressurize said upper chamber.

12. A method of installing or removing suspended submergible pumping equipment in or from an underwater well comprising lowering the equipment into or raising the equipment from the well through a container apparatus attached to wellhead apparatus of the well, said container apparatus including an elongate casing having upper and lower chambers separated by an annular blowout preventer and further annular blowout preventers at the upper end of said upper chamber and at the lower end of said lower chamber, respectively, the method including the steps of circulating cleansing liquid through said lower chamber, pressurizing said upper chamber with liquid to a pressure exceeding the pressure of liquid in said lower chamber and opening and closing said blowout preventers in timed relation to the passage of the equipment through said apparatus.

13. A method as defined in claim 12 for installing the equipment in the well wherein said container apparatus is lowered from a water surface to the wellhead with the equipment suspended in said lower chamber and the lower end of the container apparatus is then attached to the wellhead apparatus.

14. A method as defined in claim 13 including circulating liquid through said lower chamber and pressurizing said upper chamber with liquid at a higher pressure than the pressure in the lower chamber while said container apparatus is lowered from the surface to the well.

15. A method as defined in claim 12 for removing the equipment from the well including the steps of detaching said container apparatus from said wellhead apparatus when a pump assembly of the equipment is located in said lower chamber, raising the container apparatus from the well with said pump assembly located in said lower chamber and circulating liquid through said lower chamber while pressurizing said upper chamber with liquid to a higher pressure than the pressure in said lower chamber during raising of the container apparatus.

* * * * *